US008347670B2

(12) United States Patent
Rix

(10) Patent No.: US 8,347,670 B2
(45) Date of Patent: Jan. 8, 2013

(54) LOCKABLE UTILITY BOX LID

(76) Inventor: Zachary Daniel Rix, Fresno, CA (US)

( * ) Notice: Subject to any disclaimer, the term of this patent is extended or adjusted under 35 U.S.C. 154(b) by 360 days.

(21) Appl. No.: 12/710,363

(22) Filed: Feb. 23, 2010

(65) Prior Publication Data

US 2011/0203334 A1 Aug. 25, 2011

(51) Int. Cl.
*B65D 55/14* (2006.01)

(52) U.S. Cl. ..... 70/168; 70/164; 404/25

(58) Field of Classification Search ..... 70/158, 70/163, 164, 166–169, DIG. 34; 404/25; 52/221; 220/325, 327; 174/48, 50
See application file for complete search history.

(56) References Cited

U.S. PATENT DOCUMENTS

| | | | | | |
|---|---|---|---|---|---|
| 589,780 | A | * | 9/1897 | Howard | 292/202 |
| 911,256 | A | * | 2/1909 | McWane | 220/251 |
| 1,016,081 | A | * | 1/1912 | McNulty | 49/465 |
| 1,102,422 | A | * | 7/1914 | McKeon | 49/35 |
| 1,191,431 | A | * | 7/1916 | Jones | 49/61 |
| 1,191,432 | A | * | 7/1916 | Jones | 49/61 |
| 1,287,290 | A | * | 12/1918 | Golden | 49/35 |
| 1,384,712 | A | * | 7/1921 | Shanley | 404/25 |
| 1,400,399 | A | * | 12/1921 | Yaeche | 49/465 |
| 2,009,132 | A | * | 7/1935 | Gehris | 49/465 |
| 2,114,499 | A | * | 4/1938 | MacLear | 49/465 |
| 2,535,275 | A | * | 12/1950 | Dixon | 49/465 |
| 2,693,100 | A | * | 11/1954 | Wiegel | 70/168 |
| 3,343,386 | A | * | 9/1967 | Hall | 70/423 |
| 3,444,712 | A | * | 5/1969 | Greenwald | 70/423 |
| 3,465,556 | A | * | 9/1969 | McIlvenny | 70/423 |
| 3,903,721 | A | * | 9/1975 | Aaron | 70/423 |
| 3,921,494 | A | * | 11/1975 | Coe | 411/344 |
| 4,104,898 | A | * | 8/1978 | Fois | 70/419 |
| 4,523,407 | A | * | 6/1985 | Miller | 49/465 |
| 5,197,307 | A | * | 3/1993 | Abbott, Jr. | 70/164 |
| 5,697,729 | A | * | 12/1997 | Bowman | 404/25 |
| 6,007,270 | A | * | 12/1999 | Bowman | 404/25 |
| 6,568,226 | B1 | * | 5/2003 | Ramsauer | 70/127 |
| 6,763,691 | B1 | * | 7/2004 | Rafferty | 70/164 |
| 6,953,209 | B2 | * | 10/2005 | Jackson et al. | 292/66 |
| 7,007,522 | B1 | * | 3/2006 | Lee | 70/43 |

(Continued)

*Primary Examiner* — Suzanne Barrett
(74) *Attorney, Agent, or Firm* — R. Scott Kimsey

(57) ABSTRACT

One embodiment of a lockable utility box lid (20) for a utility box enclosure (10) comprises a box lid (12) having at least one upper tool aperture (22) and at least one clamping mechanism (30) coupled to the underside of the box lid (10). The clamping mechanism (30) includes at least one lower tool aperture (38) of a lock plate (32) oppositely corresponding to the upper tool aperture (22) of the box lid (12). The lock plate (32) may be coupled to a plurality of side plates (40). The clamping mechanism (30) may also include a pivot arm (60) coupled with a jaw plate (72). A pivot tab (34) of the lock plate (32) may be inserted through a pivot tab aperture (76) of the pivot arm (60) thereby creating a fulcrum point. A back plate (50) inserted into a plurality of back plate apertures (52) of the side plates (40) and a threaded plate (64) inserted into a plurality threaded plate apertures (68) of the pivot arm (60) may be aligned to receive a bolt (80). A bolt head (82) of the bolt (80) may be aligned beneath the lower tool aperture (38). A handled tool (92) may be inserted first through the upper tool aperture (22) and again through the lower tool aperture (38) where it may insert into a bolt head cavity (84) of the bolt head (82) wherein a rotation of the handled tool (92) will produce a transitional movement of the at least one clamping mechanism (30) between an engaged and disengaged position.

12 Claims, 8 Drawing Sheets

U.S. PATENT DOCUMENTS 7,176,376 B2 * 2/2007 Stachowiak, Jr. ..... 174/50
7,347,070 B1 * 3/2008 Spector ..... 70/169
7,347,071 B2 * 3/2008 Nakai et al. ..... 70/186
7,363,787 B2 * 4/2008 Yukihara et al. ..... 70/252
7,455,474 B2 * 11/2008 Tievant et al. ..... 404/25
7,475,515 B2 * 1/2009 Machledt et al. ..... 52/169.7
7,547,051 B2 * 6/2009 Burke et al. ..... 292/206
7,866,194 B2 * 1/2011 Liu ..... 70/395
7,946,143 B2 * 5/2011 Rafferty et al. ..... 70/164
8,178,795 B2 * 5/2012 Roy ..... 174/666
2006/0021403 A1 * 2/2006 Kuo ..... 70/454
2010/0326149 A1 * 12/2010 Chang et al. ..... 70/423

* cited by examiner

DETAIL 1C OF FIG. 1B

SECTION 6B-6B
OF FIG.6A

SECTION 6C-6C
OF FIG.6A

SECTION 7B-7B
OF FIG.7A

LOCKABLE UTILITY BOX LID

CROSS REFERENCE TO RELATED APPLICATIONS

This application claims the benefit of Provisional Patent Application No. 61/154,425, filed 2009 Feb. 22 by the present inventor.

FEDERALLY SPONSORED RESEARCH

Not Applicable

SEQUENCE LISTING

Not Applicable

BACKGROUND-FIELD

This application generally relates to utility box lids, specifically to a utility box lid with one or more integral clamping mechanism(s).

BACKGROUND-PRIOR ART

Conventional utility boxes are used to house various utilities including, but limited not to, electrical, telecommunication, fiber optic, water and other similar utilities and their related appurtenances. Originally utility box lids were made to rest in place on a recessed lip of the box enclosure over the upward facing opening so that the uppermost surface of the lid and top rim of the enclosure are flush. When installed in conjunction with an underground utility system, these surfaces are generally exposed and intentionally placed at or near grade level thereby permitting future access to the below-grade utility or utilities housed by the components comprising the entire enclosure. With an extraordinary number of box enclosures still in place today, the foremost limitation of conventional utility box lids is that they lack the ability to be adequately fastened. Other utility box lids are equipped to be fastened using threaded fasteners but the heads of the fasteners are typically exposed and easily accessible thereby minimally restricting unauthorized access.

Thereafter, other methods of securing a utility box lid to the enclosure box were designed but also suffer from limitations. One example is U.S. Pat. No. 7,547,051 B2 to Burke et al, 2009 Jun. 16 that discloses a bolt-type fastener where the fastener is configured in an L-shaped formation which differs fundamentally from the aforementioned conventional methods. However, the commonality is that the head of the fasteners are also upwardly exposed and easily accessible thus allowing for the possibility of unauthorized manipulation of the fastener and access to the contents housed in the enclosures. Another means of securing a utility box lid is disclosed in U.S. Pat. No. 7,475,515 B2 to Machledt et al, 2009 Jan. 13 where a keyed cylinder and accompanying key are used to secure a small door over a cavity housing the locking mechanism lever. The orientation of this cylinder is such that the entry point for the key is upward facing making it prone to receive granular particles such as dirt, sand, etc. that could prevent the key from entering the cylinder. The keyed cylinder may also be made not to function properly should an improper object be jammed or forced into the keyed aperture. In the same disclosure, a secondary means of securing the enclosure is a lever equipped with a hasp-type feature to accept a common padlock. In addition to the same susceptibility to granular particles, padlocks expose another set of disadvantages in that they can be easily cut or pried open.

Another example of securing a lid is disclosed in U.S. Pat. No. 7,347,070 B1 to Spector, 2008 Mar. 25 where a locking mechanism rotates rods to a position beneath a rim of the enclosure box. This device is implemented by either retrofitting to an existing lid or by being integrated within a newly manufactured lid. Contemplating the retrofit option, one disadvantage exists in that its attachment to an existing lid requires several holes to be accurately drilled to accept at least eight bolts. This method of implementation is largely impractical given that conventional lids are generally made of sturdy materials of varying thicknesses such as concrete, steel and the like. Thus, drilling a number of holes would be time consuming and cost prohibitive thereby restricting its potential applications. Further contemplating either method of implementation, another significant disadvantage is that device is dependant on a sheer horizontal lower lip to be present within the enclosure box in order for the lid to be retained as intended. This dependency further limits its potential use to existing enclosures with lips or alternatively, it would increase preparation time where modification to the enclosure box would be necessary. Yet another disadvantage is noticed with this locking mechanism in that the device requires no more than 180 degrees of rotation to disengage the locking rods. Further, the mechanism appears not to have an adequate restraint function to keep the rotational portion of locking mechanism from freely spinning Hence, an object other than the intended key could be forced into the key aperture to manipulate the locking mechanism with a half-turn to gain access to the enclosure therefore further diminishing the effectiveness of the mechanism.

The disclosure of U.S. Pat. No. 5,197,307 to Abbott, Jr., 1993 Mar. 30 describes yet another method using a Y-shaped device that engages under the lower edge of the sidewalls of an enclosure box coupled with a padlock or similar. The upper tab provided on the device is intended to penetrate through the existing enclosure lid where the padlock or other locking device can be attached. This method has several apparent disadvantages in that: 1) the installer of the device is required to undermine beneath the bottom edge of the enclosure to fit the device in position which can be time consuming and problematic; 2) the enclosure lid requires preparation in that a slot must be cut into the lid so as to accept the upper tab of the device which can be time consuming and problematic; 3) obstructions present in the enclosure such as conduit, pipe, cabling, meters, etc. or in cases where the bottom opening of the enclosure is sealed with a cement slurry mixture or other hardened material will further prolong or prevent installation; 4) the keyed padlock or similar locking device mounted above the surface of enclosure lid creates a tripping hazard for pedestrians where applications in paths of travel occur furthering its limitations.

At present, two other devices are known but do not incorporate the utility box lid. Rather, these devices insert into the cavity of the enclosure itself. One device is offered at mccain-inc.com and is similar to the patent to Abbott, Jr. (1993) in that it also utilizes a device that engages under the lower edge of the sidewalls of an enclosure box coupled with a padlock. The padlock retains a secondary cover below the existing enclosure lid. The second device is offered at copperwiretheft.com and is also similar to the patent to Abbott, Jr. (1993) and the above referenced device but utilizes a keyed locking cylinder in lieu of a padlock to retain a secondary cover.

Accordingly, there is a need in the field of utility box lids for an improved lockable utility box lid to minimize unauthorized access to the utility box and its contents and further reduce the risk of losses associated with the theft, vandalism, injury, repairs, related expenses and resources. Thus several advantages of one or more aspects are to provide a universally lockable utility box lid. Other advantages of one or more aspects are to provide a lockable utility box lid devoid of padlocks, keyed cylinders, readily accessible or exposed fasteners and the like. These and other advantages of one or more aspects will become apparent from consideration of the ensuing description and drawings.

SUMMARY

Briefly, the present invention relates to a lockable utility box lid for use in conjunction with utility box enclosures common to underground utilities or services for deliberately restricting, preventing and/or deterring unauthorized access to the utility box enclosure, its contents and/or related appurtenances. In accordance with one embodiment a locking utility box lid comprises a box lid coupled with one or more clamping mechanisms and a plurality of tool apertures where the one or more clamping mechanisms expand to outwardly and/or upwardly press against one or more of the inward, downward and/or angled interior surfaces of the utility box enclosure thereby securing the lockable utility box lid in place.

An aspect of the present invention includes a plurality of deliberately arranged tool apertures whereby direct linear access to the one or more clamping mechanisms is prohibited by the geometric and linear configuration of the tool apertures.

Another aspect of the present invention includes a bolt comprising a bolt head having an atypical pentagonal cavity thereby further restricting, preventing and/or deterring unauthorized access to the utility box enclosure.

Yet another aspect of the present invention includes an atypical tool comprised of a tool head configured to correspond with the pentagonal cavity of the bolt head and a reduced tool shank configured to circumnavigate the plurality of tool apertures thereby allowing for the clamping mechanisms to be expanded and contracted as needed for authorized accessibility to the utility box enclosure.

Accordingly, the aforementioned and other attributes and advantages of the present invention will be fully understood considering the following detailed description of the particular embodiments of the invention and accompanying drawings.

DRAWINGS-FIGURES

DRAWINGS-REFERENCE NUMERALS

10—utility box enclosure
12—box lid
20—lockable utility box lid
22—upper keyhole-shaped tool aperture
30—clamping mechanism
32—lock plate
34—pivot tab
36—lock plate index tab
38—lower keyhole-shaped tool aperture
40—side plate
42—side plate index tab slot
50—back plate
52—back plate aperture
54—first bolt aperture (in back plate)
60—pivot arm
62—second bolt aperture (in pivot arm)
64—threaded plate
66—threaded aperture
68—threaded plate aperture
70—threaded plate keeper tab
72—jaw plate
74—jaw plate index slot
76—pivot tab aperture
80—threaded bolt
82—bolt head
90—straight-shanked tool
92—handled tool
94—operative tool end
96—tool head
98—reduced tool shank section

DETAILED DESCRIPTION-FIRST EMBODIMENT-FIGS. 1A, 1B, 1C, 2

Figure 1A:
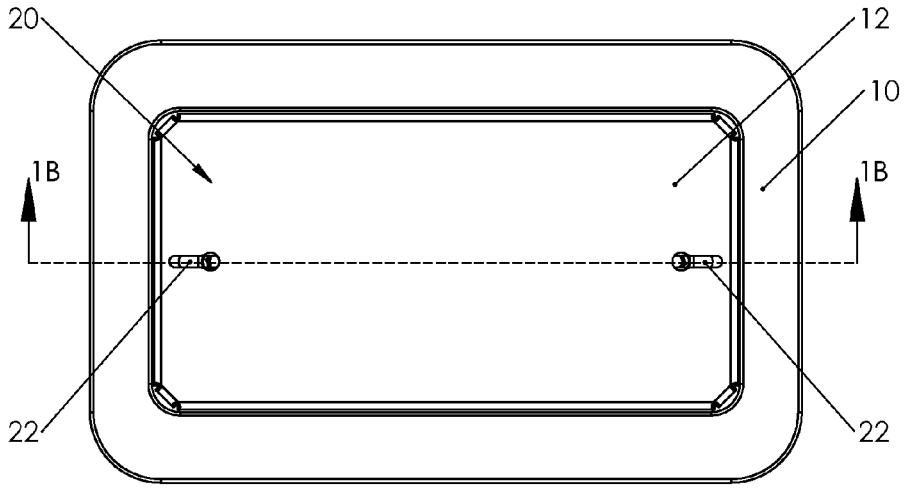
FIG. 1A is a top view of a lockable utility box lid on a utility box enclosure in accordance with the present invention.
Figure 1B:
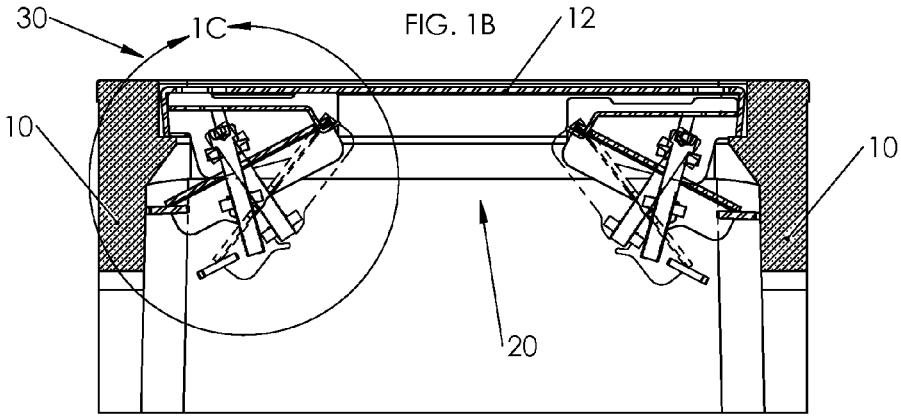
FIG. 1B is a section view along section line 1B-1B of FIG. 1A of a lockable utility box lid on a utility box enclosure in accordance with the present invention.
Figure 1C:
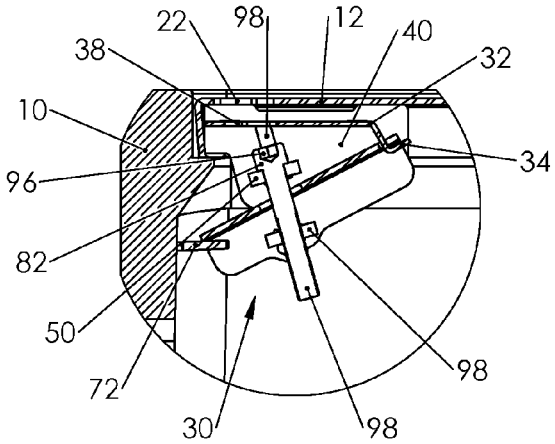
FIG. 1C is a magnified view of detail C of a clamping mechanism taken from FIG. 1B and from along section line 1B-1B of FIG. 1A of a lockable utility box lid on a utility box enclosure in accordance with the present invention.
Figure 2:
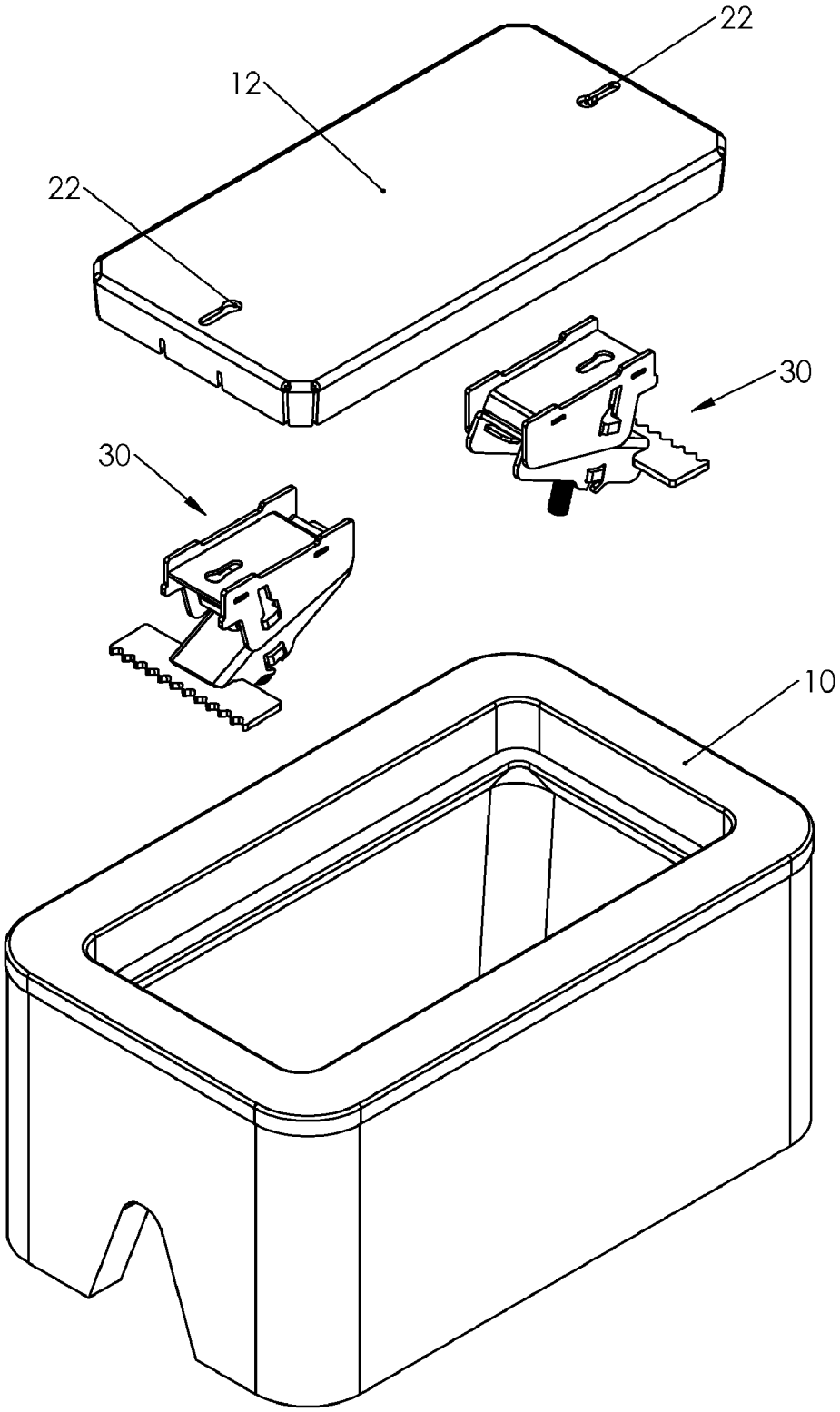
FIG. 2 is a semi-exploded perspective view of a box lid and a plurality of clamping mechanisms in relationship to a utility box enclosure in accordance to the present invention.

One embodiment of a lockable utility box lid is illustrated in FIG. 1A (top view), FIG. 1B (section view), FIG. 1C (magnified section view of clamping mechanism) and FIG. 2 (semi-exploded view). FIG. 1A depicts a top view of a lockable utility box lid 20 in place within a utility box enclosure 10 over the upward facing open end of the box where FIG. 1B depicts a section view taken along section line 1B-1B of FIG. 1A. The box lid 12 may include one or more upper keyhole-shaped tool apertures 22 to allow access to a clamping mechanism 30 coupled to the box lid 12. A lockable utility box lid 20 may comprise at least one clamping mechanism 30 coupled with a box lid 12 as shown in FIG. 2. The at least one clamping mechanism 30 may be a plurality of clamping mechanisms 30. Referencing FIG. 1C with further reference to FIG. 3A (perspective view of a clamping mechanism), the clamping mechanism 30 may comprise a lock plate 32, at least one side plate 40, a pivot arm 60, a jaw plate 72, a back plate 50, a threaded plate 64, and a threaded bolt 80. The clamping mechanism 30 may be coupled to the underside of the box lid 12 to allow the pivot arm 60 to be drawn upward and/or outward so that at least one surface of the jaw plate 72 engages against one or more vertical, horizontal or angled inward or downward facing surfaces of the enclosure box 10 as shown in FIG. 1B.

Figure 3A:
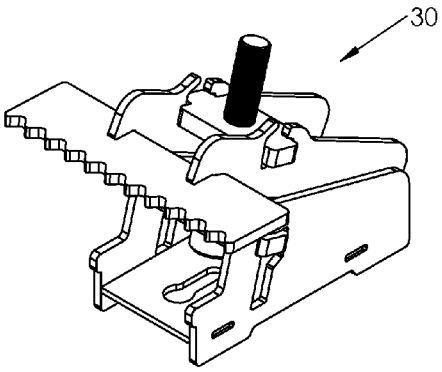
FIG. 3A is a perspective view of a clamping mechanism in accordance with the present invention.
Figure 3B:
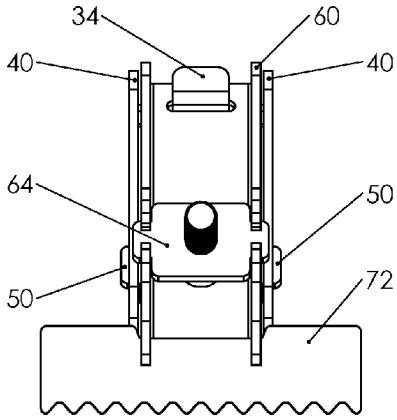
FIG. 3B is a bottom view of a clamping mechanism in accordance with the present invention.
Figure 3C:
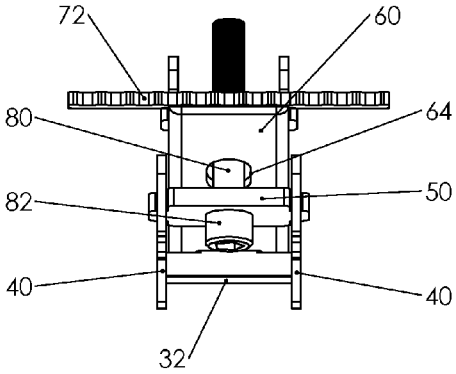
FIG. 3C is a front view of a clamping mechanism in accordance with the present invention.
Figure 3D:
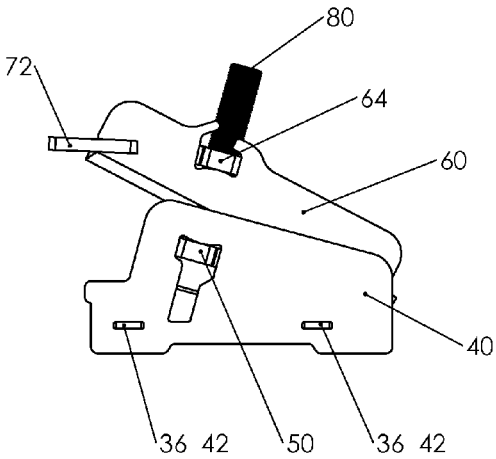
FIG. 3D is a side view of a clamping mechanism in accordance with the present invention.
Figure 4:
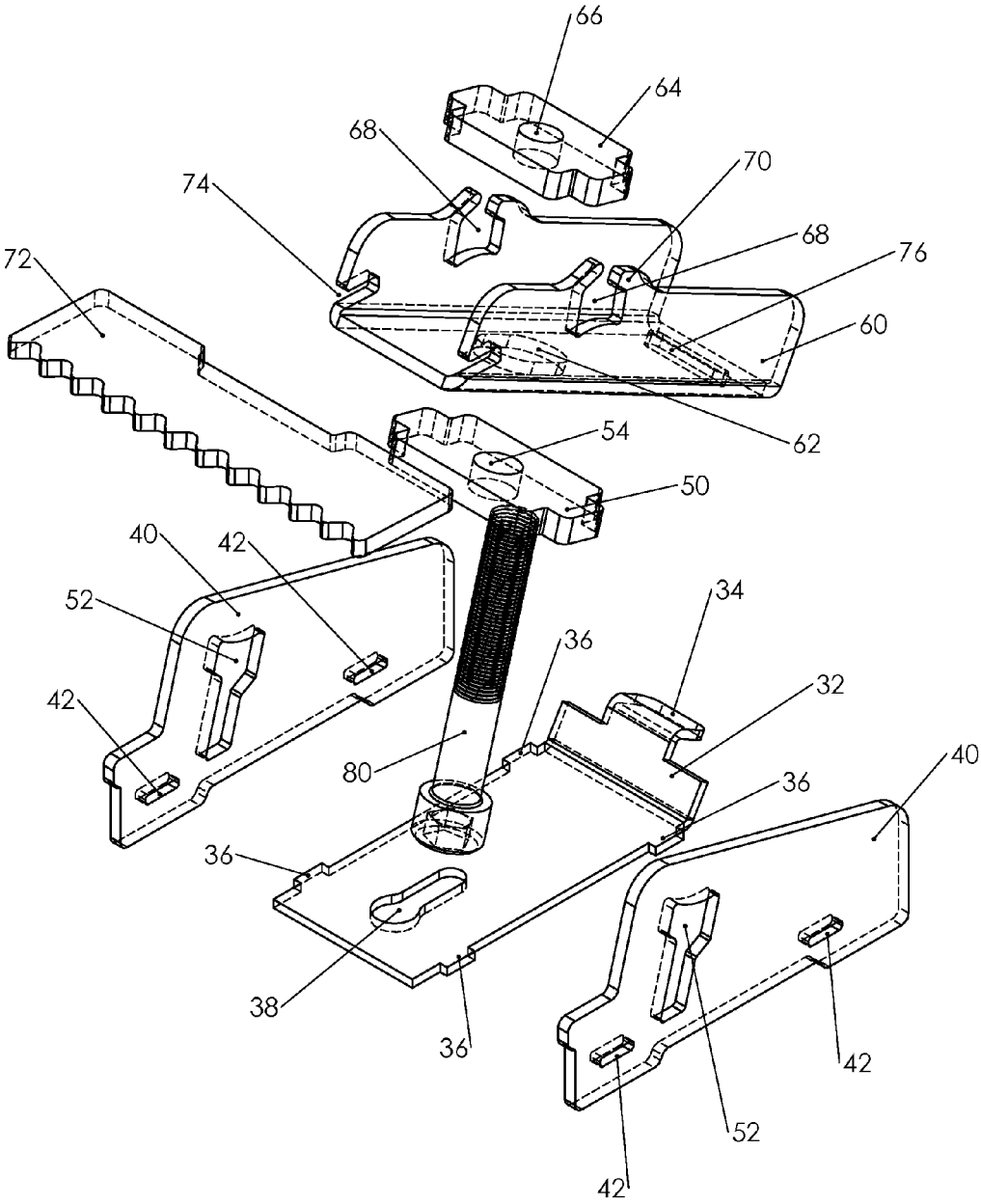
FIG. 4 is an exploded view of a clamping mechanism in accordance with the present invention.

Referring to FIG. 4 with further reference to FIG. 3A, the clamping mechanism 30 may comprise a lock plate 32 comprising a pivot tab 34, a lower keyhole-shaped tool aperture 38 and a plurality of index tabs 36. The lock plate 32 may be coupled to a plurality of side plates 40 each comprising a back plate aperture 52 and a plurality of side plate index tab slots 42. The clamping mechanism 30 may also comprise a jaw plate 72 coupled to a pivot arm 60 comprising a pivot tab aperture 76, a jaw plate index slot 74 and a pivot arm bolt aperture 62. Further, the pivot tab 34 of the lock plate 32 may be inserted through the pivot tab aperture 76 of the pivot arm 60; a back plate 50 comprising a first bolt aperture 54 inserted to its shoulders through the back plate apertures 52 in the plurality of side plates 40; a threaded plate 64 comprising a threaded aperture 66 inserted to its shoulders into the threaded plate apertures 68 of the pivot arm 60 and retained in position by threaded plate keeper tabs 70. The clamping mechanism 30 may also comprise a threaded bolt 80 first inserted through the first bolt aperture 54 of the back plate 50, again inserted through the pivot arm bolt aperture 62 of the pivot arm 60 and finally rotationally inserted into the threaded aperture 66 of the threaded plate 64. The clamping mechanism 30 may be coupled to the underside of the box lid 12.

Figure 5A:
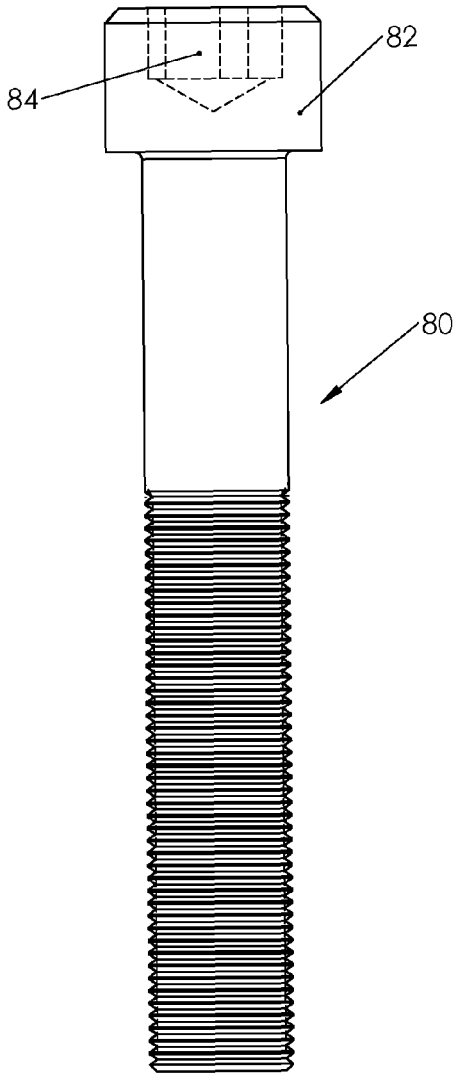
FIG. 5A is a side view of a bolt accordance with the present invention.
Figure 5B:
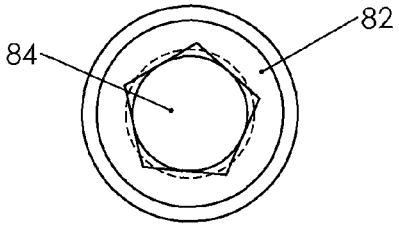
FIG. 5B is a top view of a bolt head of a bolt accordance with the present invention.

With reference to FIG. 2, the clamping mechanism 30 may be coupled to the underside of the box lid 12 so that the lower keyhole-shaped tool aperture 38 aligns with the upper keyhole-shaped tool aperture 22 of the box lid 12. The upper keyhole-shaped tool aperture 22 may comprise a first circular aperture end transitioning to a second linear aperture end resembling a "keyhole." The lower keyhole-shaped tool aperture 38 may comprise a first linear aperture end transitioning to a second circular aperture end also resembling a "keyhole." The clamping mechanism 30 may be coupled to the underside of the box lid 12 so that the second circular end of the lower keyhole-shaped tool aperture 38 of the lock plate 32 is reversely aligned with the first circular end of the upper keyhole-shaped tool aperture 22 of the box lid 12. Referring to FIGS. 5A and 5B, the threaded bolt 80 comprising a bolt head 82 and a bolt head cavity 84 may be aligned beneath the second linear end of the lower keyhole-shaped tool aperture 38 so that the bolt head cavity 84 cannot be directly accessed therethrough. It shall be understood that the second linear end of the upper keyhole-shaped tool aperture 22 and the first linear end of the lower keyhole-shaped tool aperture 38 may be substantially narrower than the bolt head cavity 84 and the tool head 96 (illustrated in FIGS. 6A and 7A). Therefore, given the oppositely aligned keyhole shaped apertures of the upper keyhole-shaped tool aperture 22 and the lower keyhole-shaped tool aperture 38, direct access to engage the threaded bolt 80 of the clamping mechanism 30 is prevented in that the second linear end of the upper keyhole-shaped tool aperture 22 of the box lid 12 is oriented directly over to the second circular end of the lower keyhole-shaped tool aperture 38 thereby creating an indirect path to engage the clamping mechanism 30. It shall be further understood that the terms "circular," "linear" and "keyhole" used in reference and to describe the illustrations and relationship of one or both the upper keyhole-shaped tool aperture 22 and lower keyhole-shaped tool aperture 38 are for exemplary purposes and is in no way a limitation of shape, configuration, or relationship of one, the other or both of the apertures.

Figure 6A:
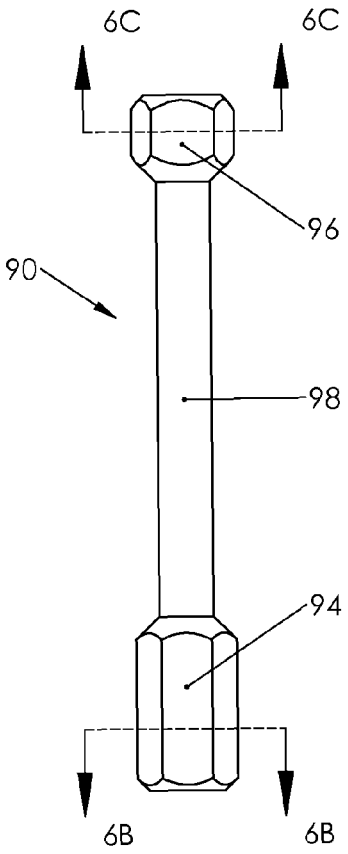
FIG. 6A is a side view of a straight-shank tool in accordance with the present invention.
Figure 6B:
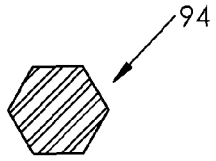
FIG. 6B is a section view along section line 6B-6B of FIG. 6A of an operative first end of a straight-shank tool in accordance with the present invention.
Figure 7A:
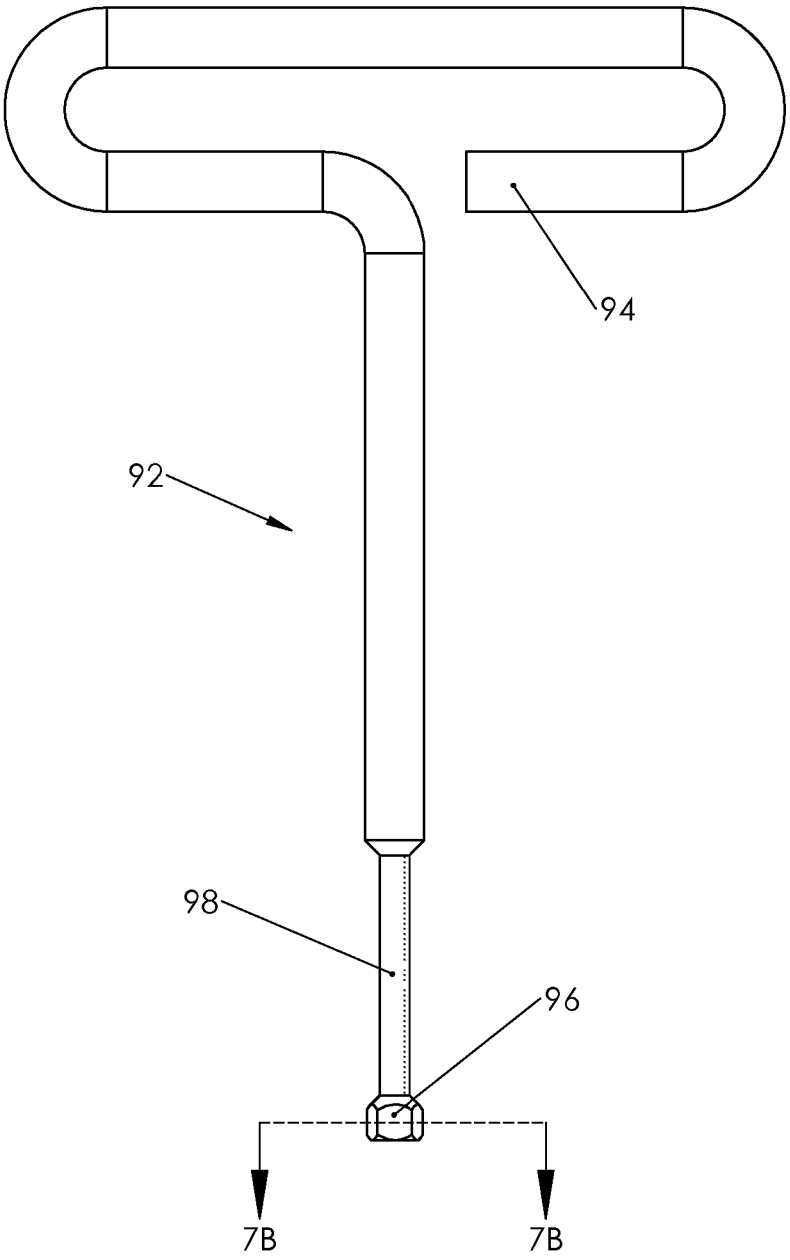
FIG. 7A is a side view of a handled tool in accordance with the present invention.

The one or more clamping mechanisms 30 coupled to the underside of the box lid 12 may be mechanically transitioned between an engaged (locked) and disengaged (unlocked) position using a straight-shanked tool 90 or a handled tool 92 such as depicted in FIGS. 6A and 7A respectively. Each the straight-shanked tool 90 and the handled tool 92 comprise an operative tool end 94, a tool head 96 and a reduced tool shank section 98 again as depicted in FIGS. 6A and 7A respectively. Rotation of the threaded bolt 80 engaged at the bolt head cavity 84 with a tool head 96 by mechanically or manually rotating the operative tool end 94 may produce transitional movement of the pivot arm 60 and jaw plate 72 of the clamping mechanism 30 between an engaged (locked) and disengaged (unlocked) position.

Figure 6C:
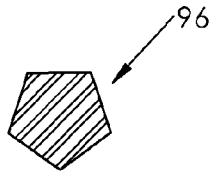
FIG. 6C is a section view along section line 6C-6C of FIG. 6A of an engaging second end of a straight-shank tool in accordance with the present invention.
Figure 7B:
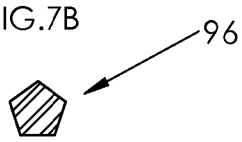
FIG. 7B is a section view along section line 7B-7B of FIG. 7A in accordance with the present invention.

Referring further to the drawings, FIG. 5B depicts a bolt head 82 and a bolt head cavity 84 having a pentagonal figure. It shall be understood that the shape of the bolt head cavity 84 may include any rectilinear, cylindrical, conical or other geometric shape or combinations thereof, either sectional or cross-sectional. Additionally, the tool head 96 as shown in the cross-sectional views of FIGS. 6C and 7B may also include any rectilinear, cylindrical, conical or other geometric shape or combinations thereof, either sectional or cross-sectional to correspond with the bolt head cavity 84.

It shall be understood that the lock plate 32 and the one or more side plates 40 may be coupled together and the pivot arm 60 and the jaw plate 72 may be coupled together and the clamping mechanism 30 and the box lid 12 may be coupled together by use of any type of coupler, including, but not limited to a weld, a nut and bolt, a clip, an adhesive, a rivet, a screw, or any other type of coupler or combinations thereof. It shall be further understood that any of the components defining any embodiment of a locking utility box lid 20 may be separately or monolithically formed, stamped, cast, molded, forged, extruded, milled or the like of any of many different types of materials (such as metals, alloys, glasses, polymers, composites, epoxies or other suitable materials irrespective of composition or method) or combinations thereof that can be readily formed into shaped objects provided that the materials or combinations thereof, including any additional steps or procedures (such as galvanizing, plating, anodizing, or any other type of coating; reinforcing, bifurcating, trifurcating, or the like) are consistent with the intended operation of a lockable utility box lid 20.

The lockable utility box lid 20 may be used in conjunction with a utility box enclosure 10 as depicted in FIG. 1A. The term "utility box enclosure" may be any type of enclosure including, but not limited to a pull box, a splice box, an access box, a valve box, a meter box, a service box, a vault and the like regardless of size, physical elements or features, material composition, whether or not in service (installed and in use), whether or not planned for service (intended to be installed in the future), or whether or not below-grade, at-grade or above-grade.

Figures 8A, 8B, 8C, 8D, 8E, 8F:
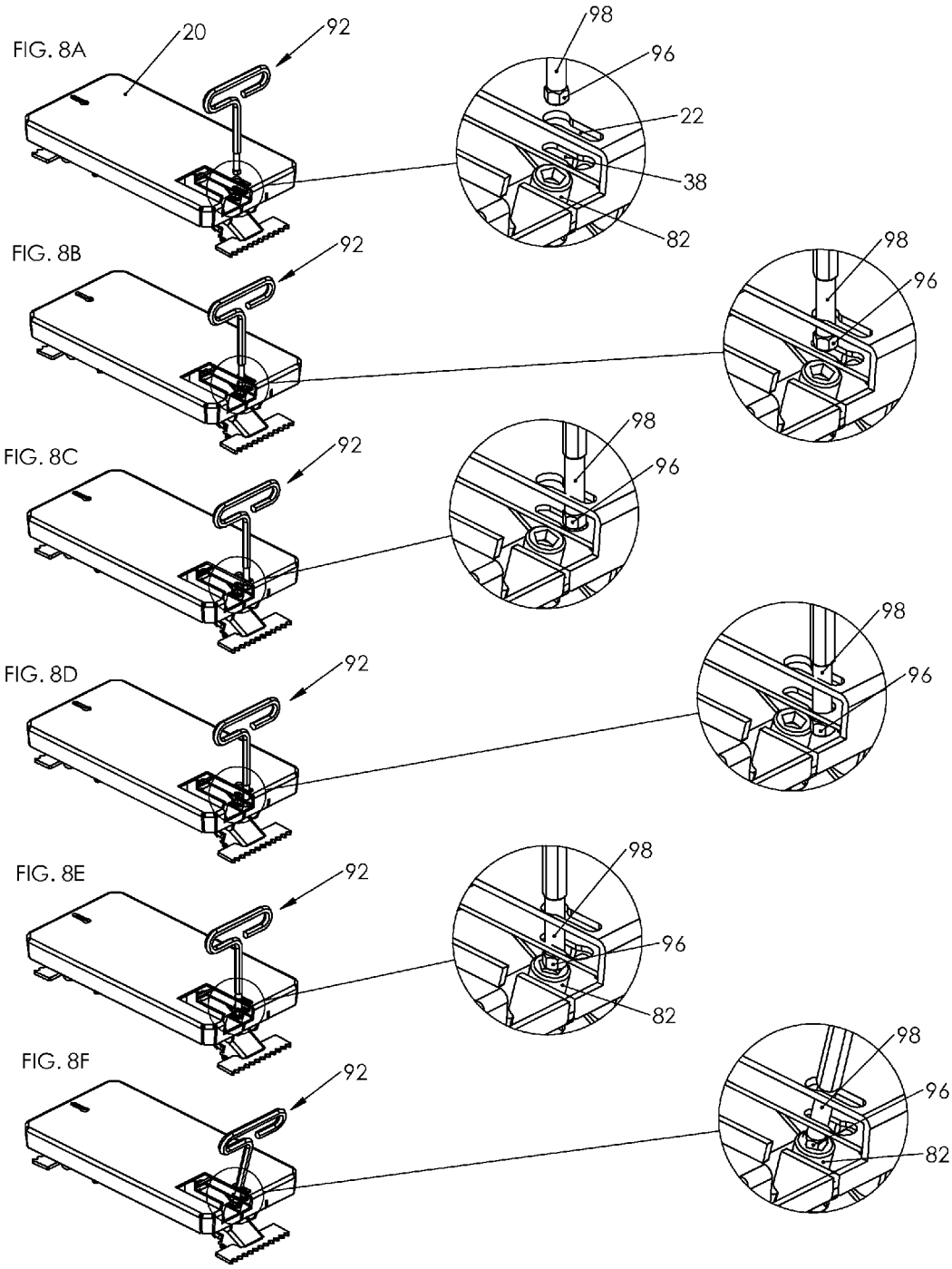
FIGS. 8A thru 8F is a flow chart of a method of engaging a clamping mechanism with a handled tool or straight-shank tool (not shown) with a cutaway section for clarity in accordance with the present invention.

First Embodiment-Operation-FIGS. 8E thru 8F

The sequential illustrations of FIGS. 8A thru 8F depict of a method of inserting the handled tool 92 into the clamping mechanism 30 as follows: The tool head 96 is first inserted downwardly through the first circular end of the upper keyhole-shaped tool aperture 22 of the box lid 12 followed by a second lateral movement of the handled tool 92 towards the second linear end of the upper keyhole-shaped tool aperture 22. With this second movement, the reduced tool shank 98 allows for the movement of the handled tool 92 into the second linear end of the upper keyhole-shaped tool aperture 22 while the tool head 96 passes beneath the same second end of the upper keyhole-shaped tool aperture 22 of the box lid 12. The third movement is again a downward so that the tool head 96 passes through the second circular end of the lower keyhole-shaped tool aperture 38 of the lock plate 32. The fourth movement is again a lateral movement (opposite the second movement) passing the tool head 96 beneath the first linear end of the lower keyhole-shaped tool aperture 38 of the lock plate 32 to a position over the bolt head cavity 84 of the bolt head 82. With the fifth and final downward movement, the tool head 96 is inserted into the bolt head cavity 84.

Referring again to FIG. 1B with further reference to FIG. 4, the threaded bolt 80 of the clamping mechanism 30 is retained in position underneath the lower tool aperture 38 by the back plate 50 whereby the first bolt aperture 54 of the back plate 50 is slightly larger than the shank of the threaded bolt 80 but smaller than the bolt head 82, thus allowing the threaded bolt 80 to be inserted therethrough and freely spin within the first bolt aperture 54. The back plate 50 is retained by the back plate apertures 52 of the side plates 40 which are coupled to the lock plate 32 and the underside of the box lid 12. The pivot tab 34 of the lock plate 32 is inserted into the pivot tab aperture 76 of the pivot arm 60 which is coupled to the jaw plate 72 where the threaded bolt 80 is then inserted through the second bolt aperture 62 of the pivot arm 60. The threaded plate 64 is inserted into the threaded plate aperture 68 of the pivot arm 60 and retained in position by the threaded plate keeper tabs 70 where the threaded bolt 80 is finally rotationally inserted into the threaded aperture 66 of the threaded plate 64.

Considering at least the foregoing, the clamping mechanism 30 can be transitionally maneuvered between an engaged (locked) and disengaged (unlocked) position by rotating the operative tool end 94 while the tool head 96 is engaged in the bolt head 82 of the clamping mechanism 30.

Rotation of the operative tool end 94 in a clockwise rotation will produce an upward and outward movement of the pivot arm 60 causing the jaw plate 72 to become in contact against one or more vertical, horizontal or angled inward or downward facing surfaces of the enclosure box 10 (as shown in FIG. 1B) thereby eventually exerting a measurable amount of force against said surface(s). Again referring to FIG. 1B, one embodiment of the present invention includes a second clamping mechanism 30 coupled to the underside of the box lid 12 opposite the first clamping mechanism 30. Engaging (locking) the second locking 30 in the same manner as the first clamping mechanism 30 as described above, the second clamping mechanism 30 will also eventually exert a measurable amount of force against an opposite one or more vertical, horizontal or angled inward or downward facing surfaces of the enclosure box 10 again as shown in FIG. 1B.

In the engaged position, the opposing upward and outward force exerted by the clamping mechanism(s) 30 against opposite vertical, horizontal or angled inward or downward facing surfaces of the enclosure box 10 coupled to the box lid 12 thereby restricts the unauthorized removal of the lockable utility box lid 20.

To disengage the clamping mechanisms 30, rotation of the operative tool end 94 in a counterclockwise rotation will produce a downward and inward movement of the pivot arm 60 causing the jaw plate 72 to disengage from the one or more vertical, horizontal or angled inward or downward facing surfaces of the enclosure box 10 as shown in phantom lines in FIG. 1B thereby eventually relieving the exerted force against said surface(s).

Description-Alternative Embodiments

Other particular embodiments of the present invention may include a clamping mechanism 30 that is coupled to the underside of the box lid 12 where the pivot arm 60 and coupled jaw plate 72 are immovably coupled to the one or more side plates 40 or the box lid 12 resembling an operational clamping mechanism 30. Further other particular embodiments of the present invention may include a plurality of box lids 12 coupled with one or more clamping mechanisms 30 capable of being sequentially interlocked or situated in the same upward facing open end of the utility box enclosure 10 to comprise a lockable utility box lid 20.

Referring to FIG. 5A, the threaded bolt 80 may be reversely threaded so that a counterclockwise rotation of the operative tool end 94 while engaged in the bolt head 82 will produce the upward and outward movement of the pivot arm 60 and a clockwise rotation will produce a downward and inward movement. Additionally, the bolt head 82 may comprise a bolt head cavity 84 comprising any rectilinear, cylindrical, conical or other geometric shape or combinations thereof where the tool head 96 corresponds with said shapes or combinations. Oppositely, the tool head 96 may comprise a tool head cavity (not shown) comprising any rectilinear, cylindrical, conical or other geometric shape or combinations thereof where the bolt head 82 corresponds with said shapes or combinations of the tool head cavity (not shown).

Referring to FIG. 7A with further reference to FIG. 8C, the handled tool 92 may double as a lifting device where, as depicted in FIG. 8C, an upward movement at this position would engage the tool head 96 with the underneath side of the second linear end of the upper keyhole-shaped tool aperture 22 of the box lid 12 thereby displacing the lockable utility box lid 20 from the upper open end of the utility box enclosure 10.

Conclusion, Ramifications and Scope

Accordingly the reader will see that one embodiment of the lockable utility box lid provides a more reliable, practical and universal device that will significantly lessen unauthorized access to valuable assets contained within the confines of utility box enclosures. In addition, the components of the various embodiments of the locking utility box lid combine to clamp into place over the upward facing opening of the utility box. Other embodiments further enhance the effectiveness of the lockable utility box lid where an intentionally indirect tool path to the operative components of the clamping mechanism and an irregular bolt head cavity configuration further reduce the possibility of tampering with or manipulation of the clamping mechanism and/or removal of the lockable utility box lid. Furthermore, the locking utility box lid has the additional advantages in that:

- it permits the production of the lockable utility box lid in any combination of length, width and/or height to retrofit into any sized utility box opening;
- it permits modular production of the lockable utility box lid where any number of box lid sections coupled with one or more embodiments of the present invention can be configured to retrofit into any sized utility box opening;

it permits efficient installation attributable to the absence of component parts requiring mechanical or manual attachment to, or engagement of, the utility box enclosure; it further permits efficient installation whereby no physical modification of the utility box enclosure is needed or required;

it permits more resistance to tampering attributable to the absence of fasteners that are directly or plainly exposed; it further permits more resistance to tampering due to the absence of padlocks and/or keyed cylinders; and it permits a greater functional reliability whereby the clamping mechanism of the lockable utility box lid is less prone to be clogged by granular particles such as sand, dirt, etc. or other environmental elements in comparison to padlocks and/or keyed cylinders where these elements may cause malfunction; it further permits a greater functional reliability whereby the clamping mechanism of the lockable utility box lid is less prone to being damaged by forceful insertion of improper objects where the same may render padlocks and/or keyed cylinders non-functional.

Although the description above contains many specificities, these should not be construed as limitations on the scope, but rather as an exemplification of one preferred embodiment thereof. Many other variations are possible. For example, the box lid of the lockable utility box lid can have other shapes such as square, round, oval, triangular, pentagonal, hexagonal, heptagonal, octagonal, etc.; the box lid can be modularized whereby each module can be coupled with one or more clamping mechanisms; the at least one clamping mechanism of a singular or modularized box lid can be a plurality of clamping mechanisms; the clamping mechanism can be made to maintain a fixed position; the clamping mechanism be can made to engage other integral physical elements of a utility box enclosure such as a rib, a lip, a cavity in a sidewall or the like without the use of force; the bolt head cavity can have other sectional or cross-sectional shapes such as square, round, oval, triangular, pentagonal, hexagonal, heptagonal, octagonal, conical, etc. or any combination thereof; the tool head insertable into the bolt head cavity can correspond to any shape of the bolt head cavity; the tool head can conversely comprise a cavity whereby the bolt head can correspond to a tool head cavity shape thereof; the threads of the bolt can be reversely threaded, coarsely threaded, finely threaded, a combination thereof or the like; the upper tool aperture can have other shapes; the lower tool aperture can have other shapes; one or more intermediate tool apertures can be incorporated between the upper tool apertures and the lower tool apertures; the fulcrum point of the pivot arm and pivot tab can be replaced with a hinge having a hinge pin or the like; the jaw plate can have other shapes; the jaw plate can be eliminated; the pivot arm and jaw plate can be made integrally; the pivot arm can be shortened, elongated, narrowed, widened, or any combination thereof or have other shapes; the side plate can have other shapes; the lock plate can be shortened, elongated, narrowed, widened, or any combination thereof or have other shapes; the side plate and lock plate can be made integrally; the lock plate index tabs and the side plate index tab slots can be eliminated; the back plate and threaded plate can have different shapes; the threaded plate can have a threaded aperture corresponding to the bolt threads; any of the components defining any embodiment of a lockable utility box lid may be made of any of many different types of materials or combinations thereof that can be formed into shaped parts provided the materials utilized are consistent with the intended use and operation of the lockable utility box lid; the box lid can be formed of sheet materials having integral slip resistant characteristics such as tread plate, diamond plate, etc; any of the components defining any embodiment of a lockable utility box lid may be coated with any of many different types of protective coatings or combinations thereof; the protective coatings can have an established static coefficient of friction for slip resistance, etc.

Accordingly, the scope should be determined not by the embodiments illustrated, but by the appended claims and their legal equivalents.

I claim:

1. A lockable utility box lid comprising:

a. at least one utility box lid having at least one upper keyhole-shaped tool aperture, wherein said at least one keyhole-shaped tool aperture has a first larger circular aperture end adjoining a second narrower linear aperture end;

b. at least one clamping mechanism coupled to the underside of the lid, the at least one clamping mechanism comprising:

c. a bolt comprising a threaded first end and an opposing second end, the second end having an integral bolt head further including a cavity;

d. a lock plate including a lower keyhole-shaped toll aperture, wherein the lower keyhole-shaped tool aperture has a first narrower linear aperture end adjoining a second circular aperture end;

e. a plurality of side plated coupled at right angles to said lock plate wherein said side plates are further coupled at right angles to the underside of the lid, whereby said lock plate is coupled to said side plates at a spaced location so as to allow a predetermined space between the opposing surfaces of said lock plate and said utility box lid;

f. a back plate including a first bolt aperture pivotably coupled to said plurality of side plates;

g. a pivot arm including a second bolt aperture pivotably coupled to said lock plate;

h. a threaded plate having a threaded aperture pivotably coupled to said pivot arm; and i. means for urging said pivot arm of said clamping mechanism in an upwardly outward direction whereby said pivot arm is caused to forcefully engage one or more inward facing vertical, horizontal, or angled interior walls of said utility box enclosure.

2. The lockable utility box lid of claim 1, wherein the first larger circular aperture end and the second narrower linear aperture end of the upper keyhole-shaped tool aperture of said utility box lid are aligned with the first narrower liner aperture end and the second larger circular aperture end of the lower keyhole-shaped tool aperture of said clamping mechanism respectively, whereby an indirectly accessible pathway is formed as a means for accessing said clamping mechanism.

3. The lockable utility box lid of claim 1, wherein said bolt is sequentially inserted therethrough the first bolt aperture of the back plate, the second bolt aperture of the pivot arm and rotatably inserted into the threaded aperture of the threaded plate, whereby the bolt is held in alignment beneath the second end of the lower tool aperture of the lock plate.

4. The lockable utility box lid of claim 1, further comprising a tool for actuating the clamping mechanism by use of the upper keyhole-shaped tool aperture and the lower keyhole-shaped tool aperture, wherein the tool accesses the cavity of the bolt head.

5. A lockable utility box lid comprising:

a) at least one utility box lid of sufficient size to cover an upward facing opening of a utility box enclosure having a plurality of vertical, horizontal, and/or angled interior facing walls;

b) at least one clamping mechanism further comprising a pivot arm coupled to the underside of said utility box lid; and c) means for urging said clamping mechanism in an upwardly outward direction whereby said pivot arm is caused to forcefully engage one or more inward facing vertical, horizontal, or angled interior walls of said utility box enclosure, wherein the at least one utility box lid includes at least one upper keyhole-shaped tool aperture, the at least one keyhole-shaped tool aperture further includes a first larger circular aperture end adjoining a second narrower linear end.

6. A lockable utility box lid comprising:

a) at least one utility box lid of sufficient size to cover an upward facing opening of a utility box enclosure having a plurality of vertical, horizontal, and/or angled interior facing walls;

b) at least one clamping mechanism further comprising a pivot arm coupled to the underside of said utility box lid; and c) means for urging said clamping mechanism in an upwardly outward direction whereby said pivot arm is caused to forcefully engage one or more inward facing vertical, horizontal, or angled interior walls of said utility box enclosure, wherein the at least one clamping mechanism further comprises a lock plate, the lock plate further comprising a lower keyhole-shaped tool aperture including a first narrower linear aperture end adjoining a second larger circular aperture end.

7. The lockable utility box lid of claim 6, further comprising a plurality of side plates coupled at right angles to said lock plate wherein said side plates are further coupled at right angles to the underside of a utility box, whereby said lock plate is coupled to said side plates at a spaced location so as to allow a predetermined space between the opposing surfaces of said lock plate and said utility box lid.

8. The lockable utility box lid of claim 7, wherein a back plate including a first bolt aperture is pivotably coupled to said plurality of said plates.

9. The lockable utility box lid of claim 6, wherein a pivot arm including a second bolt aperture is pivotably coupled to said lock plate.

10. The lockable utility box lid of claim 9, wherein a threaded plate having a threaded aperture is pivotably coupled to said pivot arm.

11. A lockable utility box lid comprising:

a) at least one utility box lid of sufficient size to cover an upward facing opening of a utility box enclosure having a plurality of vertical, horizontal, and/or angled interior facing walls;

b) at least one clamping mechanism further comprising a pivot arm coupled to the underside of said utility box lid; and c) means for urging said clamping mechanism in an upwardly outward direction whereby said pivot arm is caused to forcefully engage one or more inward facing vertical, horizontal, or angled interior walls of said utility box enclosure, wherein said utility box lid further comprises an upper keyhole-shaped tool aperture having a first larger circular aperture end adjoining a second narrower linear aperture end and wherein the said clamping mechanism further comprises a lower keyhole-shaped tool aperture having a first narrower linear aperture end adjoining a second larger circular aperture end, whereby the first larger circular aperture end of the upper keyhole-shaped aperture and the first narrower linear aperture end of the lower keyhole-shaped aperture are aligned accordingly as a means for indirectly accessing said clamping mechanism.

12. A method for locking a utility box lid, comprising:

a. providing a utility box lid of the type common to utility box enclosures comprising at least one upper keyhole-shaped toll aperture having a first larger circular aperture end, a clamping mechanism comprising a lower keyhole-shaped tool aperture having a first narrower linear aperture end adjoining a second larger circular aperture end, a pivot arm pivotably coupled to said clamping mechanism, said clamping mechanism is affixed to the underside of said utility box lid such that the first larger circular aperture end of the upper keyhole-shaped tool aperture corresponds with the first narrower linear aperture end of the lower keyhole-shaped tool aperture and the second narrower linear aperture end of the upper keyhole-shaped tool aperture corresponds with the second linear circular aperture end of the lower keyhole-shaped tool aperture, and a means for predetermining space between the upper keyhole-shaped tool aperture and the lower keyhole-shaped tool aperture;

b. providing a tool of the type comprising a first tool head end, a second operative end, and a reduced tool shank;

c. inserting the tool head first downwardly through the first larger circular end of the upper keyhole-shaped tool aperture followed by a second lateral movement of said tool towards the second narrower linear end of the upper keyhole-shaped tool aperture while the tool head passes beneath the same second narrower linear end of the upper keyhole-shaped tool aperture; a third movement is again a downward movement so that the tool head passes through the second larger circular aperture end of the lower keyhole-shaped tool aperture; a fourth movement is again a lateral movement opposite in direction to the second movement thereby passing the tool head beneath the first narrower linear aperture end of the lower keyhole-shaped tool aperture; a fifth and final downward movement engages said clamping mechanism;

d. rotating the operative end of said tool in a clockwise rotation produces a upwardly outward movement of said pivot arm, releasably urging said pivot arm to forcefully engage said utility box enclosure;

whereby said lockable utility box lid is retained in position over said utility box enclosure to restrict access to, and unauthorized manipulation of, said clamping mechanism and/or minimize unauthorized access to said utility box enclosure.

* * * * *